United States Patent [19]

Wagenfeld

[11] 4,068,319

[45] Jan. 17, 1978

[54] CHEF'S HAT

[75] Inventor: Gilbert B. Wagenfeld, Bala Cynwyd, Pa.

[73] Assignee: Cellucap Manufacturing Co., Philadelphia, Pa.

[21] Appl. No.: 694,181

[22] Filed: June 9, 1976

[51] Int. Cl.[2] ..... A42B 1/22

[52] U.S. Cl. ..... 2/197; 2/171.3

[58] Field of Search ..... 2/197, 195, 175, 171.3

[56] References Cited

U.S. PATENT DOCUMENTS

| | | | |
|---|---|---|---|
| 1,955,098 | 4/1934 | Shaffer et al. | 2/197 |
| 3,082,430 | 3/1963 | Wagenfeld | 2/197 |
| 3,348,239 | 10/1967 | Lamour | 2/171.3 |
| 3,564,612 | 2/1971 | Wagenfeld | 2/197 |

*Primary Examiner*—Werner H. Schroeder
*Assistant Examiner*—Peter Nerbun
*Attorney, Agent, or Firm*—Edelson and Udell

[57] ABSTRACT

A disposable high-walled chef's hat made of paper or like flexible sheet material cut, scored and folded to provide a hat structure or assembly having a flexible crown piece and a head-encircling head band part respectively secured to opposite ends of the wall part of the hat, which wall part is provided with a plurality of closely spaced vertically extending flat pleats. Opposite ends of the pleats are locked against unintentional unfolding thereof and the pleated wall which forms the outer facing of the hat may be internally backed by an inner liner. The crown piece, which is formed of a flat panel folded upon itself interiorly of the hat structure and in conjunction with the remaining folded parts thereof, is so doubled upon itself and adhesively joined together along a line of limited extent spaced between and paralleling the top and bottom edges of the hat assembly as to permit it to be drawn in extended condition across the top of the hat when the same is expanded into shape for wear thereof to thereby provide a top closure for the hat having an opening therein for ventilating the interior of the hat.

12 Claims, 12 Drawing Figures

FIG. 1
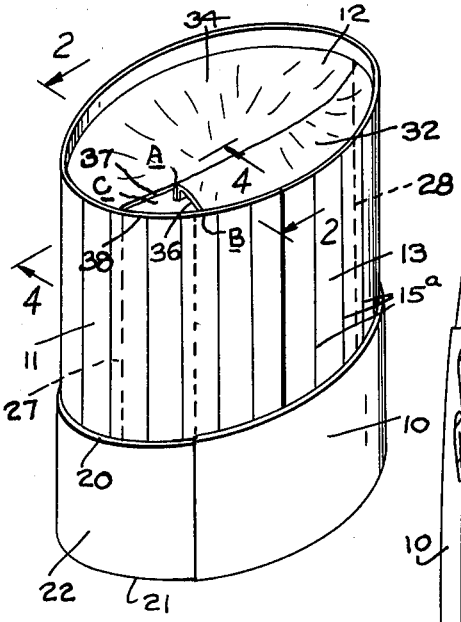
FIG. 3
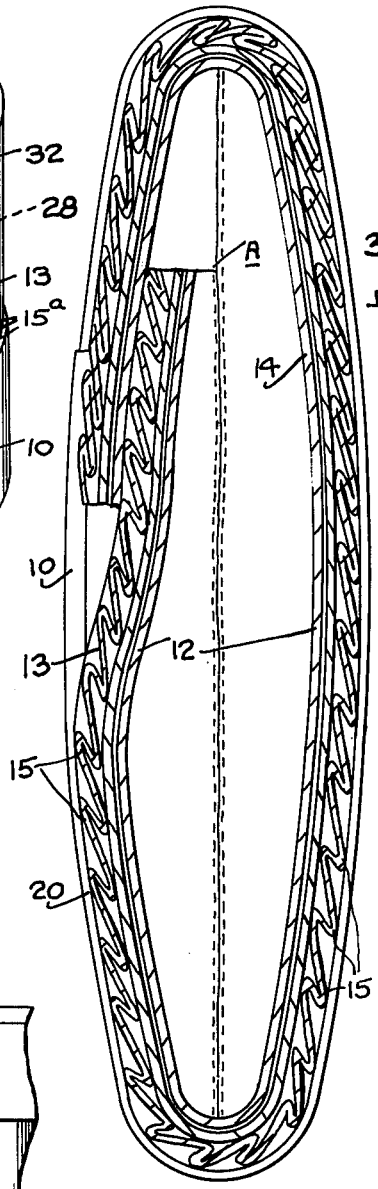
FIG. 2
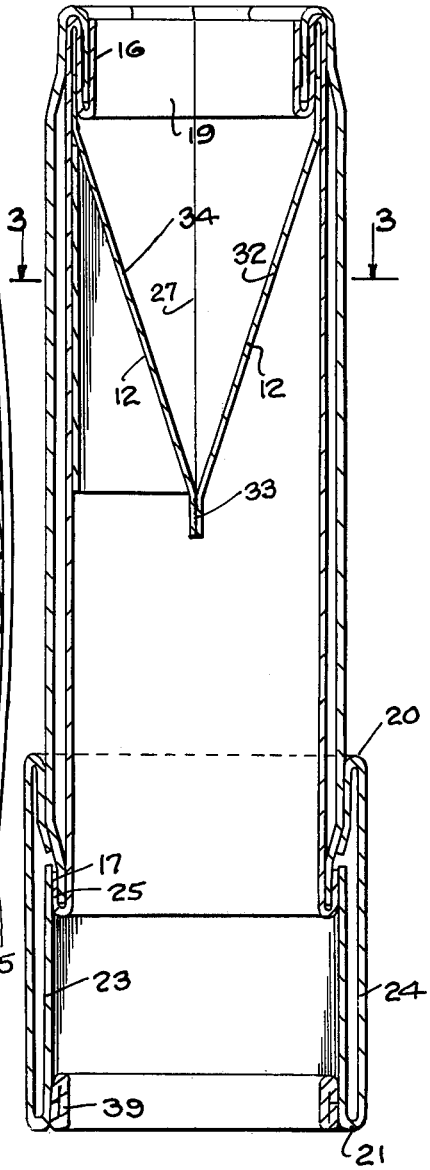
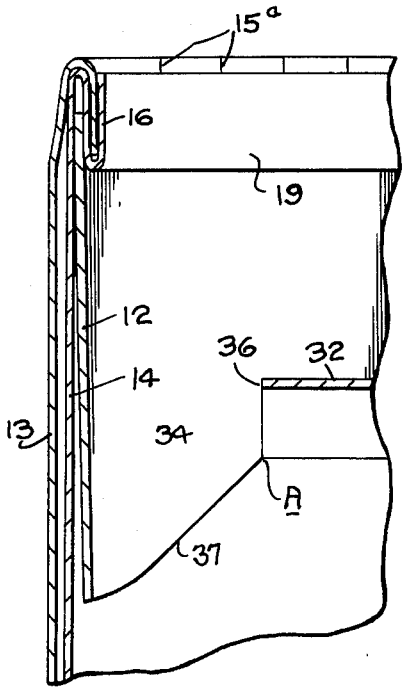
FIG. 4

CHEF'S HAT

This invention relates to paper hats and more particularly to disposable hats of the kind generally referred to as a chef's hat having a relatively high side wall topped off with a crown part which covers the top of the wearer's head.

Among the principal objects of the present invention is the provision of a chef's hat of the character described having a relatively high pleated side wall and a crown piece so integrated therewith as to provide a structure which may be folded into substantially flat compact form for convenient space-saving storage and shipment thereof and yet be easily expanded into generally circular shape to fit the head of the wearer without destroying or otherwise impairing the manufactured integrity of the hat.

Another object of the invention is to provide the hat with a neatly appearing vertically pleated side wall formed of light-weight flexible sheet material and in which the pleats are held secured in overlapping flattened form against any untoward distortion thereof during the operation of expanding the hat into its head-fitting shape.

Still another object of the invention is to provide a chef's hat structure wherein all of its component parts are fabricated of rectangular blanks of sheet material and in which the said individual parts are so integrated into the structure as integral elements thereof as to enable it to be easily folded into the form of a flat compact unit for purposes of storage and shipment thereof in quantity without any wrinkling or other distortion of any of said component parts.

A further important object of the invention is to provide a chef's hat having a head-covering crown piece which is so constructed and secured within the top edge portion of the hat as an integral element thereof that when the hat is in its flat-folded condition the said crown piece is flat-folded upon itself interiorly of the so-folded hat and yet may be automatically drawn into an extended head-covering condition when the hat is expanded into generally circular shape for wear thereof.

A still further object of the invention is to provide a flat-foldable pleated high-walled chef's hat having a top crown or head-covering part which is of such construction and so incorporated into the foldable hat structure as an integrated component thereof that when the hat is expanded into its shape for use the said top crown part automatically provides an opening for ventilating the interior of the hat while it is being worn.

The foregoing and other objects of this invention will be apparent from a reading of the following specification considered in conjunction with the accompanying drawings, it being understood that the invention consists in the combination, construction, location and relative arrangements of parts, all as described in the specification, as shown in the drawings and as finally pointed out in the appended claims.

In the accompanying drawings:

FIG. 1 is a perspective view of a chef's hat constructed in accordance with and embodying the principles of the present invention, showing the same in its expanded condition ready to be worn;

FIG. 2 is a vertical sectional view as taken along the line 2—2 of FIG. 1, but showing the hat in a partially flattened condition;

FIG. 3 is a horizontal sectional view as taken along the line 3—3 of FIG. 3;

FIG. 4 is a partial horizontal sectional view as taken along the 4—4 of FIG. 1;

Figure 5:
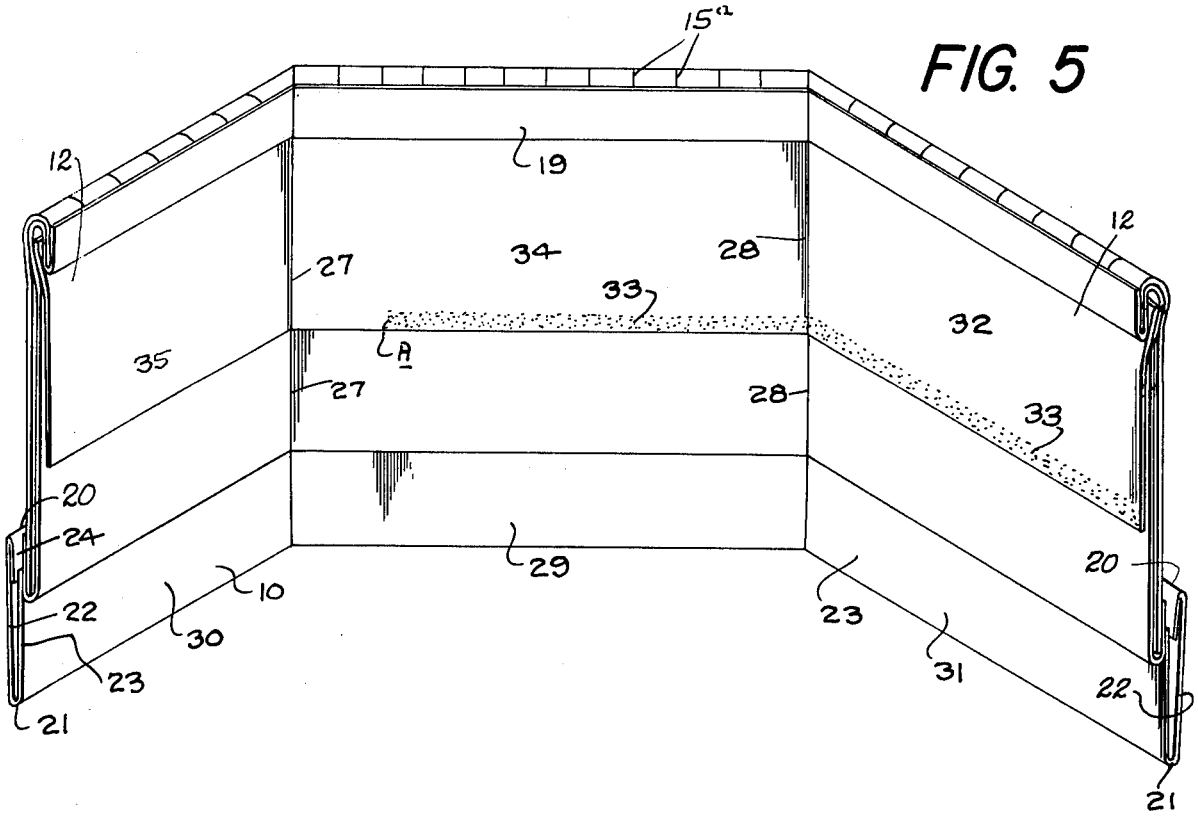
FIG. 5 is a perspective view looking toward the inner side of the hat structure showing the vertical fold lines along which the structure is folded upon itself into its flattened condition as shown in FIGS. 2 and 3.
Figure 6:
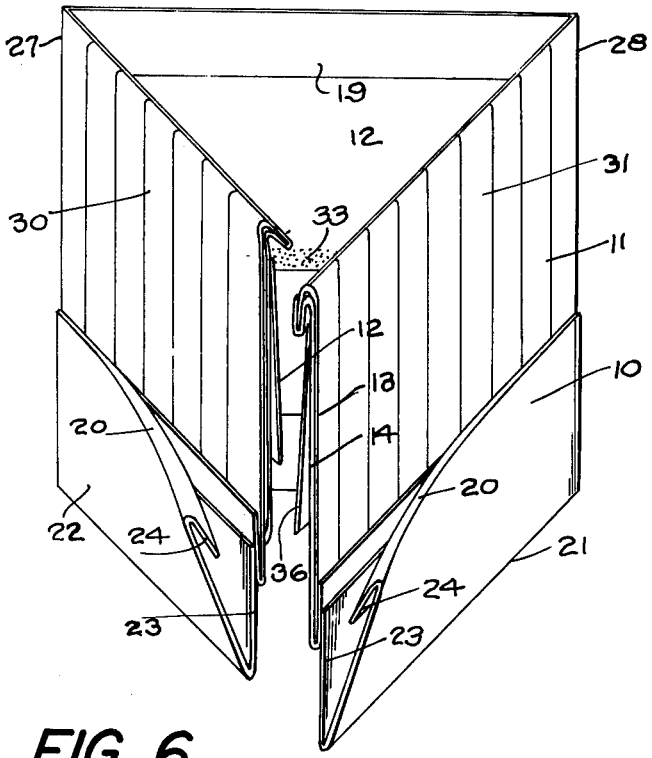
FIG. 6 is a perspective view showing the hat structure of FIG. 5 partially folded upon itself into condition just prior to telescopic interengagement of the freely extending end portions of the hat structure.

Referring now to the drawings and more particularly to FIGS. 1 to 7 which illustrate one form of the chef's hat of the present invention, it will be observed that its main parts generally comprise a lower head band part 10, a side wall part 11 and a top piece or crown 12, which parts are formed of flat blanks of pliable sheet material, such as paper or the like.

Figure 7:
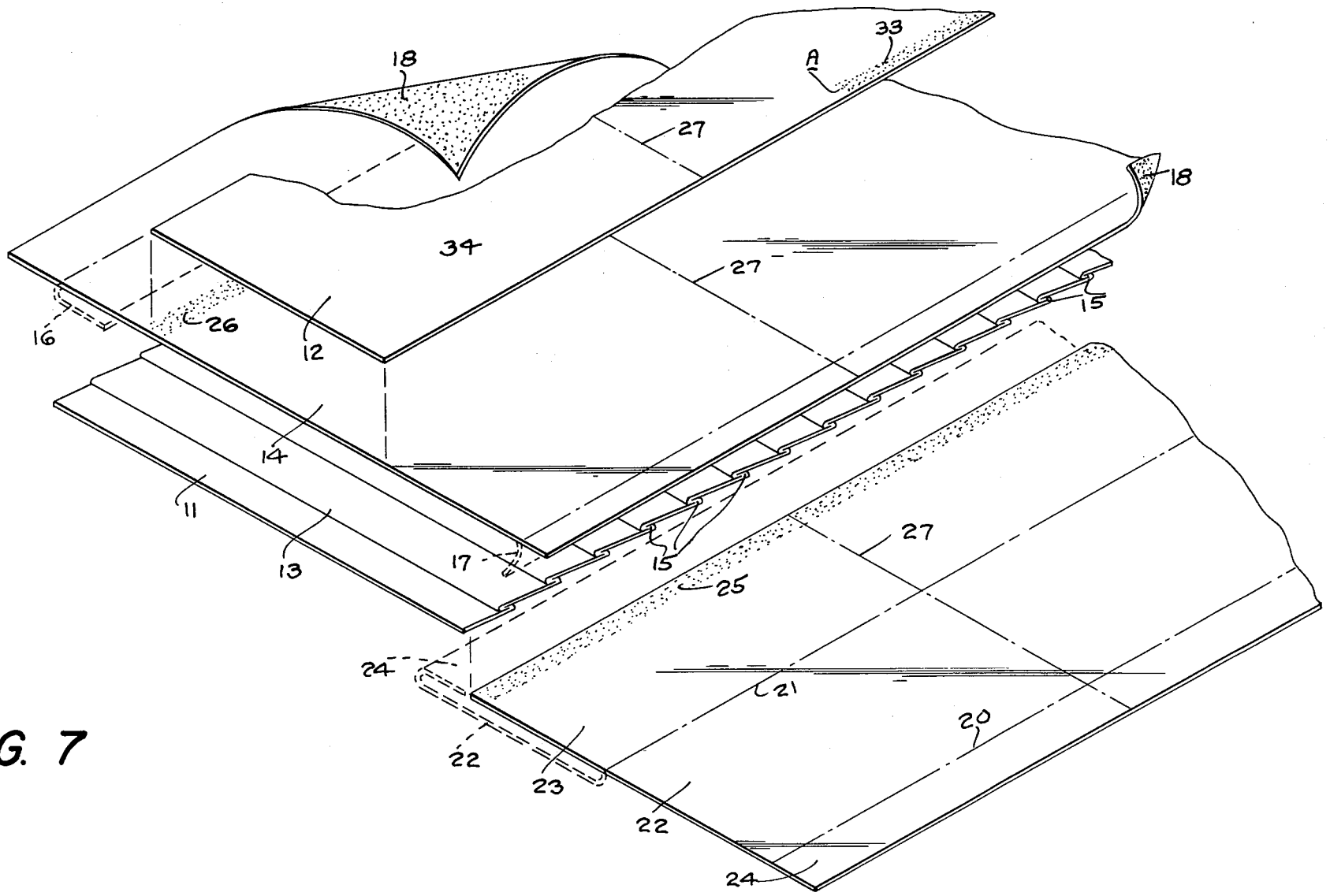
FIG. 7 is a partial exploded view of the several component parts of the structure prior to their assembly as shown in FIG. 5.

In the form of construction of the hat as illustrated in FIGS. 1 to 7, the side wall part 11 of the hat, which projects upwardly above the top edge of the head band part 10 as a vertical extension thereof, consists of an outer facing 13 of lightweight paper stock, such as tissue or crepe paper, which is backed on its inner face by a liner 14, also of lightweight flexible paper or the like, so that the side wall of the hat is of a two-ply construction. In its preferred form, the outer facing 13 is vertically creased and folded upon itself to provide the same with a series of closely spaced vertically extending flat pleats 15 of the character best shown in FIGS. 3 and 7, it being understood that while these pleats are shown in FIG. 3 for illustrative purposes as being more or less opened up, in actuality the said pleats are quite flat and disposed in overlapping relation. The actual pleat formations, as illustrated in FIGS. 3 and 7, are represented in the remaining Figures by the vertically extending pleat lines 15$^{a}$.

In order to lock the pleats 15 in a neatly appearing substantially flat, overlapping relation, the opposite longitudinally extending edge portions of the pleated facing 13 are respectively adhesively secured to corresponding edge portions of the liner 14 which are reversely turned, as at 16 and 17, to overlie the outer surfaces of the pleats 15 along the top and bottom edges of the pleated facing. These turned edge portions of the inner liner 14 thus serve as hems which respectively bind therein the opposite extremities of the pleats 15. Since both the outer and inner surfaces of the pleats embraced by the hems 16–17 are adhesively secured therein, the pleats are held intact, at both the top and bottom ends thereof, against both inside and outside unfolding and other undesired deformation thereof from their original overlapped and flattened shape. In this connection, it will be noted as shown in FIG. 7, that both the top and bottom edge portions of the liner 14 are each coated with a film 18 of adhesive spread over an area of sufficient breadth to commonly embrace both the outer and inner surfaces of the pleats, the free ends of which are thus locked in flattened condition within the opposite hems 16–17 of the liner 14.

The upper edge portion of the pleated outer facing 13, embraced by the hem 16 of the liner 14 and assembled as above described to form the upwardly extending two-ply side wall section of the hat, is inturned to provide a downwardly projecting internal flap 19 which extends along the full length of the assembly shown in FIG. 5, the fold of which downwardly turned flap thus forms the top edge of the finished hat.

The bottom edge portion of the combined pleated outer facing 13 and its liner 14 is adhesively secured to the head band part 10 of the hat, which latter part is formed of a blank of relatively stiff material of the same length as that of the side wall part of the hat. This head band part 10 is doubled upon itself along the longitudinally extending parallel fold lines 20 and 21 to provide an outer panel 22 which forms the visible portion of the hat band and a pair of oppositely turned inner panels 23 and 24 having freely extending edge portions. The upturned inner panel 23 of the hat band part 10 is adhesively secured, as by a line of adhesive 25 (see FIG. 7), to the hemmed bottom edge portion of the above described pleated side wall part of the hat.

Also included as a part of the hat assembly is the crown piece 12 which is formed of a rectangular blank of flexible sheet material, such as tissue or crepe paper or criniline. This crown piece blank, while equal in length to the overall length of the head band and pleated side wall assembly just described, is of a width substantially less than that of side wall part of the hat and is secured to the inner face of said side wall part 11 as a panel which freely extends downwardly from the top edge portion of said side wall part for a distance approximately half the overall depth of the side wall part of the hat structure. As is most clearly shown in FIGS. 5 and 7, the upper longitudinally extending edge of this crown piece 12, which is adhesively secured to the inner face of the lining 14 of the pleated outer facing 13 of the hat, as by a line 26 of adhesive (see FIG. 7), is covered by the downturned flap 19 which forms the top edge of the hat.

The hat structure which so includes the depending crown piece 12 as an integrated element thereof will thus be seen as being in the form of a multi-ply unit which is of an overall length when in its extended flattened form substantially exceeding the girth of the head upon which the hat is to be worn. The multiply unit so constructed is provided with vertically extending parallel crease or fold lines 27 and 28 suitably spaced apart to provide a main central section 29 and a pair of oppositely projecting end sections 30 and 31 of unequal length.

These end sections 30 and 31 of unequal lengths are of a combined length exceeding that of the central section 28 so that when the end sections are folded flatwise against the central section they overlap one another. It will be observed that this overlap occurs not only in respect to the head band part 10 of the hat but also in respect to the side wall part 11 and the crown part 12 and that the extent of this overlap is substantially uniform throughout its vertical extent.

The head band portions of the overlapping section 30 and 31 of the described structure are adapted to be telescopically interfitted so that the longer head band section telescopically embraces the shorter one to thereby provide a hat which extends completely about the head. Although the overlapped sections of the hat structure includes the inwardly turned flanged top edges of the split side wall portions, these top edges are secured together against any shifting thereof relatively to one another by a film of adhesive applied between the engaged surfaces of the overlapped hemmed portions 16 which form the top edge of the hat. Of course, another suitable means, such as staples or the like, may be employed to hold the interfitted top edges of the hat together against separation. Thus, it is only the telescopically engaged overlapped portions of the head band 10 that are primarily relatively separable for adjustment of the hat to any desired head size.

As most clearly appears in FIGS. 2, 5 and 7, only limited portions of the longitudinally extending bottom edges of the folded crown part 12 are adhesively secured together. Thus, it will be noted that it is only the bottom edge of that portion of the crown part 12 which is coextensive in length with the longer end section 31 of the hat assembly shown in FIG. 5, namely the end section 32 of the crown part 12, that is adhesively secured, as by the line of adhesive 33, to the bottom edge of the central section 34 of the crown part. This adhesive securement of the end section 32 of the crown part 12 to its central section 34 along the bottom edge portion of said crown part is effected upon folding the end section 31 of the assembly shown in FIG. 5 flatwise against its central section 29 and prior to telescopic interengagement of the head band sections which form the split adjustable side of the hat.

Since the line of adhesive 33, which joins together the coincident bottom edges of the overlapped portions of the crown part 12, extends only from the rear fold line 28 of the hat structure to the point A (FIGS. 1, 5 and 7) which is inwardly spaced from the front fold 27, the remaining portion of the crown part 12, including the shorter section 35 thereof, is left freely disposed relatively to adjoining portions of the hat structure. Thus, when the hat structure with its separable head band sections telescopically engaged is expanded into its head-fitting shape as shown in FIG. 1, the segments of the crown part which have their bottom edges adhesively joined together, as by the line of adhesive 33, are drawn upwardly from their depending condition shown in FIG. 2 into a condition as shown in FIG. 4, that is, onto a raised condition extending more or less flatwise across the expanded top portion of the hat.

It will be seen that as said adhesively joined segments of the crown part 12, i.e., the segments 32 and 24, are raised into their said elevated position, the infolded end 36 of the raised end section 31 of the crown part 12 will then extend outwardly from the point A to the point B where said crown-part is secured to the top of the hat (as see FIG. 1). There is thus left an opening or vent C in the top or crown of the hat immediately adjacent the front portion thereof, which opening is of a generally triangular shape defined by the aforesaid infolded end 36 of the raised crown part section 31, the unsecured bottom edge 37 of the partially raised crown part section 35 and the segment 38 of the side wall part 11 of the hat which extends arcuately from the aforesaid point B to the front fold line 28 of the hat structure.

It will be understood that in its finished form the hat structure of the present invention as best shown in FIG. 5 is adapted to be folded upon itself along the fold lines 27-28 as above described to provide a flat compact unit which may be readily expanded into its generally circular shape as shown in FIG. 1 to fit the head of the wearer of the hat. Preferably, in its flattened condition the overlapping portions of the head band part 12 of the hat are telescopically interengaged for subsequent relative adjustment thereof by the user of the hat to provide it with the desired head size.

The particular manner of incorporating the crown part 12 in the hat is an important feature of the present invention since it not only provides the aforesaid opening or vent C for ventilation of the hat while it is being worn, but also makes it possible to neatly fold the hat into its flattened form without subjecting the crown part to any wrinkling or other undesired distortion. Also of importance is the fact that the construction of the ventilation opening C is such that as the aforesaid segment 38 of the side wall part of the hat is drawn into its generally arcuate form shown in FIG. 1 the aforesaid end 36 of the infolded crown part section 32 and the unsecured bottom edge 37 of the remaining portion of the flat folded crown part 12 are so relatively movable with respect to one another as well as to said side wall segment 38 of the hat as to relieve the crown part of such strains and stresses that might tend to tear the lightweight crown-forming material in the vicinity of the vent opening C as the hat is being expanded to shape.

If desired, the hat structure may be provided with a sweat band 39 adhesively or otherwise secured to the inner surface of the bottom edge portion of the head band part 10, and also the said head band may be provided with any suitable means (not shown) for adjustably fixing it to any desired head size, such as the head band size adjusting and locking means shown and described in my prior U.S. Pat. No. 3,082,430.

Figure 8:
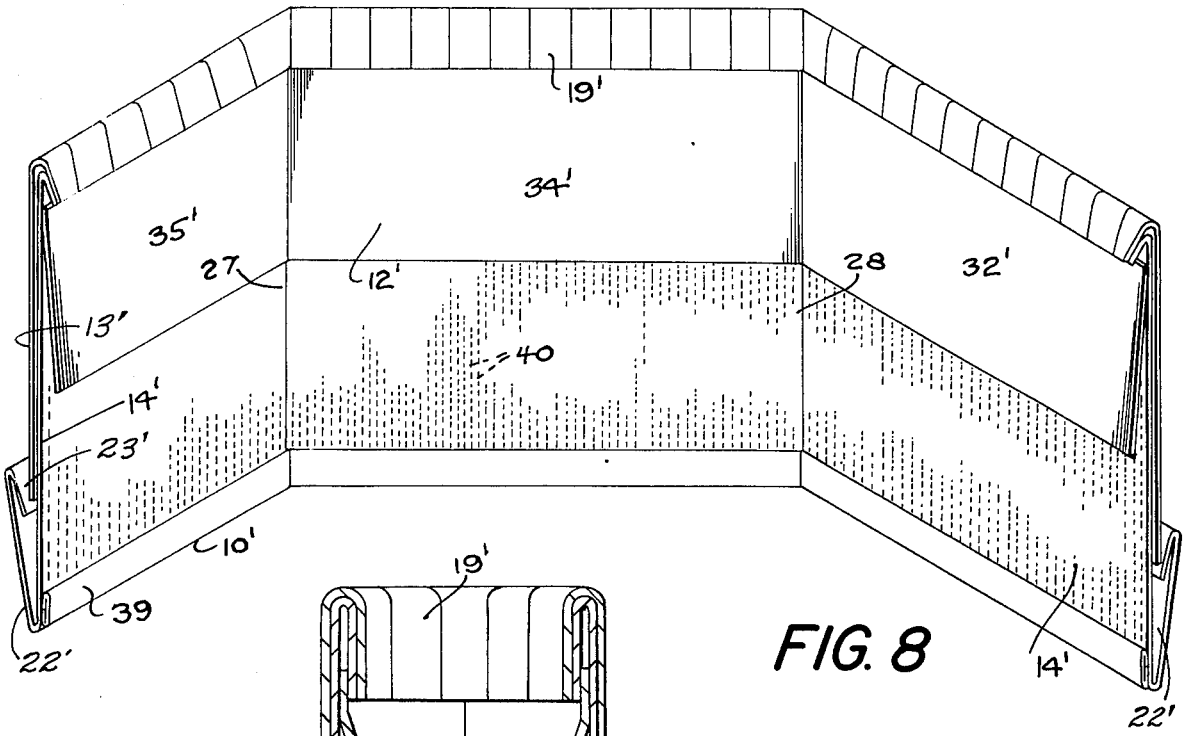
FIG. 8 is a view similar to that of FIG. 5 showing a first modified construction of the hat.
Figure 9:
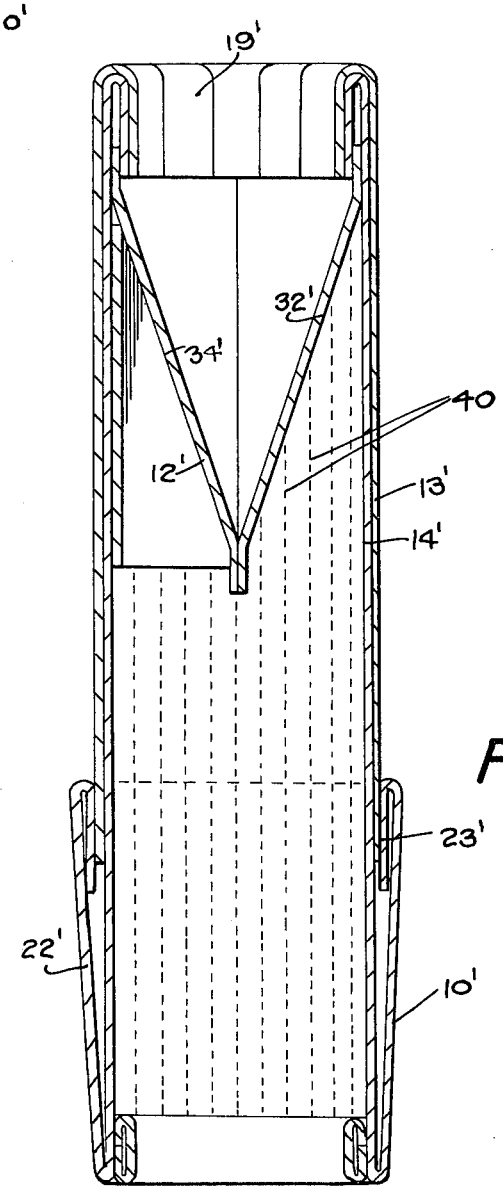
FIG. 9 is a vertical sectional view of said first modification of the hat as taken along a line corresponding to the line 2—2 of FIG. 1.

FIGS. 8 and 9 illustrate a modified construction of hat wherein the inner lining 14' is extended downwardly beyond the bottom edge of the pleated outer facing 13' and is then doubled upon itself to provide a head band part 10' for the hat having the visible outer panel 22' terminating at its upper edge in a downturned inner flat 23'. Since the head band is desirably made of heavier paper stock than that of the pleated outer facing 13', in order to provide the lining 14' with the desired degree of flexibility, the portion thereof which serves as a backing for the more highly flexible pleated outer facing 13' and which extends downwardly beyond the bottom end of said facing is provided with a series of relatively closely spaced parallel lines of perforations 40. In all other material respects the hat construction of FIGS. 8 and 9 is the same as that shown in FIGS. 1 to 7 inclusive, it being noted that in the illustrated mofification of FIGS. 8 and 9 all parts thereof which are equivalent to those in the first described construction are indicated by similar reference characters having single prime marks.

Figure 10:
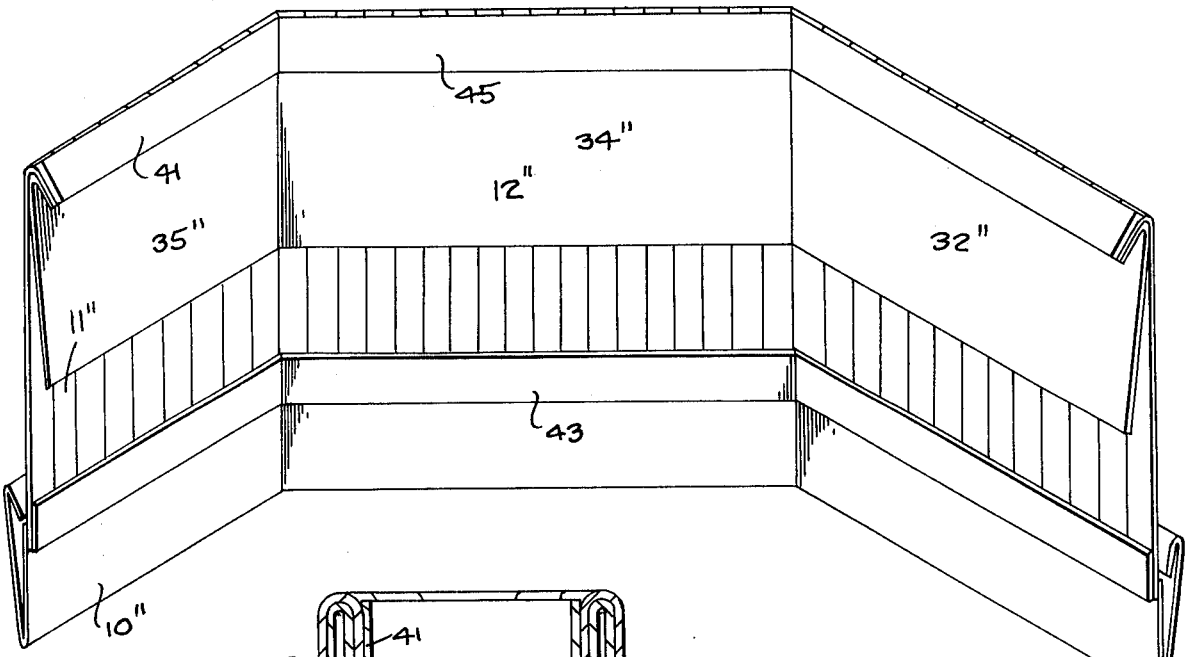
FIG. 10 is a view also similar to that of FIG. 5 showing a second modified construction of the hat.
Figure 11:
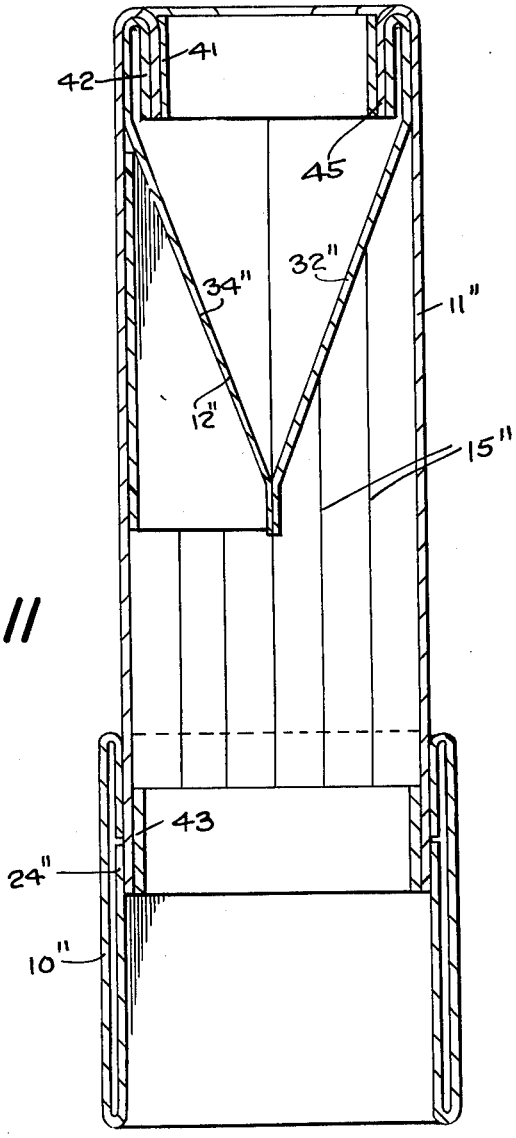
FIG. 11 is a vertical sectional view of said second modification of the hat as taken along a line corresponding to the line 2—2 of FIG. 1.

FIGS. 10 and 11 illustrate still another modification wherein all parts of the hat structure equivalent to those present in the first described structure are designated by similar character references having double prime marks. In this modified form of the hat structure, the side wall part 11'' thereof is not provided with any lining as in the previously described hat structures. In order to secure the ends of the pleats 15'' against their opening up, the topmost ends of the pleats are locked in place between a narrow strip 41 of paper adhesively secured to the outer surface of said pleats and the top edge portion 42 of the crown part 12'' adhesively secured to the inner surface of said pleats.

Similarly, the bottommost ends of the pleats 15'' are locked in place between a narrow strip 43 of paper adhesively applied to the inner surface of the pleats and the upper edge portion 44 of the upturned inner panel 24'' of the head band part 10''. In this modification it will be noted that the upper longitudinally extending edges of the pleated side wall part 11'' and the crown part 12'' are coincident with the outer longitudinally extending edge of the strip 41 and that the adhesively locked-in topmost ends of the pleats 15'' are inturned to provide a downwardly turned finish flap 45 extending along the full length of the hat structure.

Figure 12:
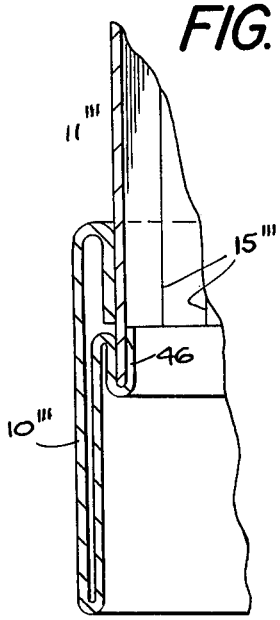
FIG. 12 is a partial sectional view of the head band portion of the hat showing still another modification of its construction.

FIG. 12 shows a further modification generally similar to that of FIGS. 10 and 11 but wherein the bottom ends of the pleats 15'' are adhesively locked in place by a reversely turned upper portion 46 extending along the full length of the upturned inner panel 24''' of the head band part 10''' of the hat structure.

It will be understood that the present invention is susceptible of various other changes and modifications which may be made from time to time without departing from the general principles or real spirit thereof, and it is accordingly intended to claim the same broadly, as well as specifically, as indicated in the appended claims.

I claim:

1. A disposable chef's hat comprising a head band part, a side wall part extending vertically above the upper edge of said head band part and a crown part secured to the upper marginal portion of said side wall part, all of said parts being respectively formed of individual rectangular blanks of flexible sheet material cut to equal lengths and joined together along parallel lines extending horizontally about the peripheral extent of the hat with the corresponding ends of all of said blanks in vertical registry, said joined blanks being commonly creased along a pair of vertically extending lines spaced apart a distance less than half the overall length of said blanks to provide a flat folded assembly thereof having opposite side panels extending from front to rear of the hat, one of said side panels being continuous in length and the other being split between said crease lines to provide it with a pair of sections of unequal length disposed in overlapping relation, and wherein:

a. said head band part of the hat is horizontally folded upon itself to provide an outer panel of uniform depth having downwardly and upwardly turned inner portions freely overlying the inner face of said outer panel, the overlapping end sections of said head band being telescopically interengaged for adjustment thereof to a selected head size, b. said side wall part of the hat, formed of a material of substantially greater flexibility than that of said head band, is folded upon itself to provide it with a plurality of closely related vertical pleats spaced about the full circumferential extent thereof and has its bottom edge portion secured to said upwardly turned inner portion of the head band so that it extends upwardly beyond the upper edge of said head band to provide the hat with a side wall of substantial height rising as a vertical extension of said head band, and c. said crown part, formed of a material having a flexibility at least as great as that of said pleated side wall part, is disposed interiorly of said hat with its flat folded sections respectively disposed in overlying relation to the corresponding flat-folded sections of said side-wall part and its top horizontally extending marginal portion secured throughout the full length thereof to the corresponding top marginal portion of said side wall part of the hat, said crown part depending freely from its said secured top marginal portions thereof to a level intermediate the horizontally extending top and bottom edges of said side wall part of the hat, the longer one only of the overlapped sections of the split side panel of said crown part having its depending horizontally extending bottom marginal portion thereof secured along the full extent thereof to the corresponding marginal portion of that section of the opposite side panel of said crown part which extends continuously between the aforesaid vertically extending crease lines of the hat whereby when said hat is expanded from its flat folded condition into a generally circular head-fitting shape the sections of the opposite side panels of the crown part which have their marginal bottom portions secured together are drawn into a position extending generally flat-wise across the top of the expanded hat while the remaining unjoined portions of said crown part are relatively spread apart to provide an opening for ventilating the interior of the hat.

2. In a hat as defined in claim 1 wherein the opposite side panels of the crown part are of such uniform depth that when the marginally joined portions thereof are spread apart into their aforesaid flat-wise condition across the top of the hat they are of a combined width at least equal to the expanded diameter of the hat.

3. In a hat as defined in claim 1 wherein the upper marginal edge portion of said side wall part is inturned to provide a flap which overlies the corresponding marginal portions of said crown part.

4. In a hat as defined in claim 1 wherein said pleats extend the full vertical extent of said side wall part of the hat in substantially flattened form and are secured at their opposite ends against unfolding thereof out of their said flattened form.

5. In a hat as defined in claim 1 wherein said pleated side wall part of the hat is provided with a liner of flexible sheet material overlying the inner face of said pleated side wall part.

6. In a hat as defined in claim 5 wherein the top and bottom edges of said liner are respectively provided with inturned flaps which overlie and secure in position the corresponding ends of the pleats of said pleated side wall.

7. In a hat as defined in claim 5 wherein said liner is an integral vertical extension of said upwardly turned inner portion of said head band part.

8. In a hat as defined in claim 7 wherein the portion of said liner which extends as an integral extension of said head band is provided with means for rendering the same relatively more flexible than the outer panel of said head band.

9. In a hat as defined in claim 1 wherein the upwardly turned inner portion of said head band part terminates in a horzontal plane disposed in parallel relation to and spaced below the top edge of said head band and wherein the bottom ends of said side wall pleats of the hat are secured against unfolding out of flattened form by means embracing opposite faces of said pleat ends in secured relation to the freely extending marginal edge portion of said upwardly turned inner portion of said head band.

10. In a hat as defined in claim 1 wherein the upwardly turned inner portion of said head band terminates in a reversely folded flap which embraces and has secured therein the bottom ends of the pleats of said side wall part of the hat.

11. In a hat as defined in claim 1 wherein the bottom ends of the pleats of said pleated side wall part of the hat is embraced by and secured between a freely extending edge portion of said upwardly turned inner portion of the head band and a strip of sheet material which respectively overlie opposite faces of said pleated side wall.

12. In a hat as defined in claim 1 wherein said ventilating opening in the top of the expanded hat is of a generally triangular shape defined on two sides thereof by angularly related unjoined edges of said crown part and on its third side by an arcuately extending top edge portion of the side wall part of the hat.

* * * * *